US012618294B2

(12) United States Patent
Asthana et al.

(10) Patent No.: US 12,618,294 B2
(45) Date of Patent: May 5, 2026

(54) WET CONNECT METHOD WHICH INCLUDES STABBING THE INNERMOST LAYER OF A CONFORMAL MULTILAYER SOFT SHELL APPARATUS CONTAINING CONDUCTIVE MATERIAL

(71) Applicant: SAUDI ARABIAN OIL COMPANY, Dhahran (SA)

(72) Inventors: Pranay Asthana, Dhahran (SA); Euan Murdoch, Aberdeenshire (GB); Rae Younger, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 390 days.

(21) Appl. No.: 18/324,717

(22) Filed: May 26, 2023

(65) Prior Publication Data

US 2024/0392631 A1 Nov. 28, 2024

(51) Int. Cl.
*E21B 17/02* (2006.01)

(52) U.S. Cl.
CPC ..... *E21B 17/0285* (2020.05); *E21B 17/028* (2013.01)

(58) Field of Classification Search
CPC ..... E21B 17/028; E21B 17/0285
See application file for complete search history.

(56) References Cited

U.S. PATENT DOCUMENTS

| | | | |
|---|---|---|---|
| 4,032,214 A | 6/1977 | McNerney | |
| 4,669,792 A | 6/1987 | Kjeldstad | |
| 5,174,765 A | 12/1992 | Williams et al. | |
| 5,700,161 A | 12/1997 | Plummer et al. | |
| 5,823,257 A | 10/1998 | Peyton | |
| 6,776,636 B1 | 8/2004 | Cameron et al. | |
| 7,340,819 B2 | 3/2008 | Guven et al. | |
| 7,644,755 B2 | 1/2010 | Stoesz et al. | |
| 7,866,414 B2 | 1/2011 | Patel | |
| 7,955,105 B2 * | 6/2011 | Maeland | H01R 13/523 439/201 |
| 8,839,850 B2 | 9/2014 | Algeroy et al. | |
| 9,175,523 B2 | 11/2015 | Patel et al. | |
| 9,761,962 B2 | 9/2017 | Nicholson | |
| 10,316,593 B2 | 6/2019 | Pike | |

(Continued)

FOREIGN PATENT DOCUMENTS

| | | |
|---|---|---|
| FR | 2826792 B1 | 9/2007 |
| GB | 1117379 A | 6/1968 |

OTHER PUBLICATIONS

International Search Report issued for corresponding international patent application No. PCT/US2024/030387, mailed Aug. 19, 2024 (5 pages).

(Continued)

*Primary Examiner* — Vanessa Girardi
(74) *Attorney, Agent, or Firm* — Osha Bergman Watanabe & Burton LLP

(57) ABSTRACT

Embodiments disclosed herein relate to a conformal multilayer soft shell apparatus and a system to make a downhole connection between an electric power supply, a conformal multilayer soft shell apparatus, and a downhole system requiring power. The conformal multilayer soft shell apparatus may include an innermost layer with one or more electrically conductive materials, a number of middle layers, and a protective outermost layer.

19 Claims, 6 Drawing Sheets

(56) References Cited

U.S. PATENT DOCUMENTS

| | | | |
|---|---|---|---|
| 10,533,381 | B2 | 1/2020 | Head et al. |
| 10,851,606 | B2 | 12/2020 | August et al. |
| 10,934,785 | B2 | 3/2021 | Fripp et al. |
| 2003/0211768 | A1 | 11/2003 | Cameron et al. |
| 2015/0184467 | A1 | 7/2015 | Patel et al. |
| 2020/0032620 | A1 | 1/2020 | Steele |

OTHER PUBLICATIONS

Written Opinion issued for corresponding international patent application No. PCT/US2024/030387, mailed Aug. 19, 2024 (8 pages).

* cited by examiner

WET CONNECT METHOD WHICH INCLUDES STABBING THE INNERMOST LAYER OF A CONFORMAL MULTILAYER SOFT SHELL APPARATUS CONTAINING CONDUCTIVE MATERIAL

BACKGROUND

In hydrocarbon well operations, a variety of systems that are operated in the downhole environment may require an electrical connection to be established from the surface of the well. For example, monitoring systems and sensors located downhole can be used to measure wellbore properties when connected to a power source. Establishing a strong electrical connection between the wellhead and such systems may be challenging, for example, due to navigating complicated well geometries and corrosive wellbore fluids which can lead to electrical losses.

Accordingly, there exists a need for a wet connect method which minimizes electrical losses in complicated hydrocarbon well environments, such as deep wells, multi-lateral wells, and high hydrogen sulfide ($H_2S$) environments, among others.

SUMMARY

Embodiments herein are directed toward a conformal multilayer soft shell matrix apparatus that may be used establish a high voltage electrical connection in such challenging environments. This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a conformal multilayer soft shell apparatus. The conformal multilayer soft shell apparatus includes at least an innermost layer which includes an electrically conductive material or materials. The conformal multilayer soft shell apparatus may include a number of middle layers and an outermost layer. Embodiments disclosed herein also relate to a system to create a downhole electrical connection between an electric power supply, a conformal multilayer soft shell apparatus, and a downhole system requiring power.

Other aspects and advantages of the claimed subject matter will be apparent from the following description and the appended claims.

DETAILED DESCRIPTION

Figure 1:
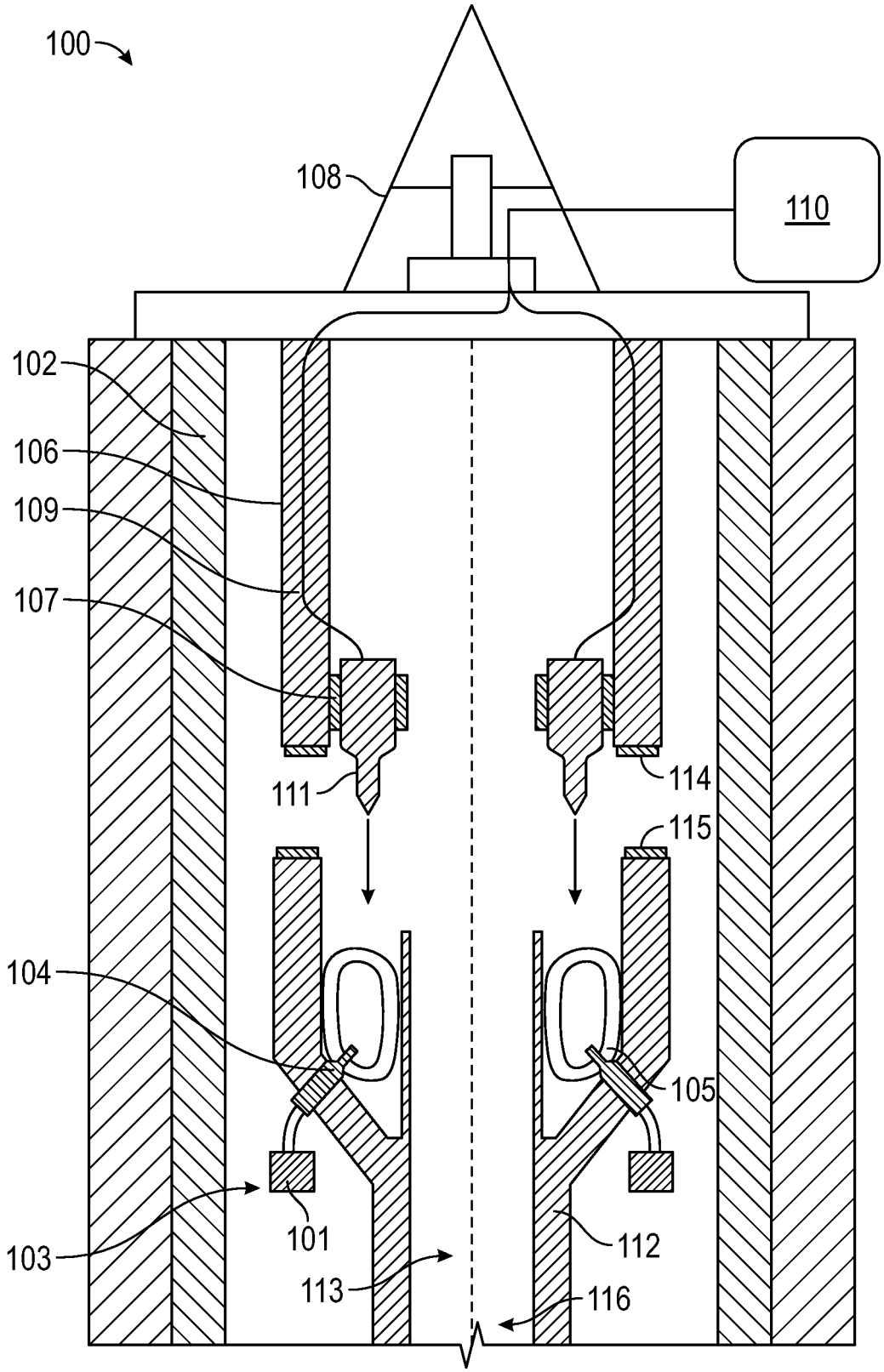
FIG. 1 shows a schematic of a system to create a downhole electrical connection with a conformal multilayer soft shell apparatus of one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a conformal multilayer soft shell apparatus. Specifically, embodiments disclosed herein relate to a system and method to create a downhole electrical connection using a conformal multilayer soft shell apparatus.

FIG. 1 shows a system to create a downhole electrical connection 100 in an oil or gas well. A downhole system requiring power 101 may be deployed inside casing 102 inside a wellbore 103. In one configuration, lower completion tubing 112 may house a female connector 104 pre-installed on the downhole system requiring power 101 and may also be pre-connected to a conformal multilayer soft shell apparatus 105. To create an electrical connection with the downhole system requiring power, upper completion tubing 106 with a mating connector 107 located at its bottom joint may be run in the wellbore 103 from the wellhead 108. The centerline 113 of the upper completion tubing is shown by a dashed line, which is inside the lower completion tubing inside area 116. A string containing an electric power cable 109 is run from an electric power supply 110 at the wellhead around the tubing, whose end is a male connector with a stabbing tool 111. As the upper completion tubing 106 is run-in-hole towards the lower completion tubing, the stabbing tool containing a male connector 111 moves (dashed arrow) towards the conformal multilayer soft shell apparatus 105 until it stabs the innermost layer that contains an electrically conductive material, which completes the electrical circuit. In one or more embodiments, there may be multiple mating connectors 107 that are radially disposed in the bottom joint around the dashed centerline 113 of tubing. A mechanical connection is formed between an upper connector 114 on the upper completion tubing 106 and a lower connector 115 on the lower completion tubing 112. The mechanical connection may be a through latch, collet, bodylock ring, one way ratchet, or any other suitable mechanical connection device known in the art. The conformal multilayer soft shell apparatus is described in more detail in FIG. 3.

In one or more embodiments, as an alternative to the upper completion tubing 106 of FIG. 1, the male connector may be run by wireline for connection with a female connector already downhole and associated with a tool requiring power. In this case, the wireline provides electric power 109 from the electric power supply 110 at the wellhead. The wireline is used to run the male connector with a stabbing tool 111 downhole into contact with the conformal multilayer soft shell apparatus 105.

In one or more embodiments, the conformal multilayer soft shell apparatus 105 of FIG. 1 may be pre-installed with multiple female connectors which are radially disposed in the conformal multilayer soft shell apparatus 105.

The connection method which includes stabbing the innermost layer of a conformal multilayer soft shell apparatus is advantageous because it is insensitive to tool orientation and bore centralization. It also prevents mechanical wear damage due to the soft contact nature of the conformal multilayer soft shell apparatus (i.e., no metal on metal contact). Furthermore, the electrical connection has minimized losses due to full metal contact, allowing for higher voltage transmission from the power source at the surface of the well to the downhole system requiring power. Therefore, the connection method could be used in very deep wells without loss of integrity of the electrical connection.

A downhole electrical connection may be required for a variety of reasons in oil and gas well completions. One example is sensors and monitoring systems which provide wellbore information for intelligent well completions. Other systems or devices that may require or use electricity for operation may also be connected in this manner, such as valves, pumps, or others of the numerous downhole devices known to those skilled in the art that may require electricity may also benefit from electrical connection systems described herein.

The connection mechanism which closes the electrical path across the conformal multilayer soft shell apparatus may be any connection mechanism known in the art, such as one containing a male connector and a female connector. In one iteration, the male or female connector may be pre-installed into the conformal multilayer soft shell apparatus. In this case, stabbing motion would only be required by the male or female connector which is not pre-installed in the apparatus. A mating connector may be required to receive the male and/or female connector. One example of a mating connector is a bulkhead connector. Alternatively, both male and female connectors could be mobile and stabbing into the multi-layer shell sac based on the well geometry and specific design needs.

A stabbing tool may be part of the connection mechanism, in combination with a male and/or female connector. The stabbing tool may be any stabbing tool known in the art, such as a stab connector. In one or more embodiments, a stabbing tool (or tools) is part of the male and/or female connector and is used to stab through the soft material layers of the conformal multilayer soft shell apparatus.

Figure 2:
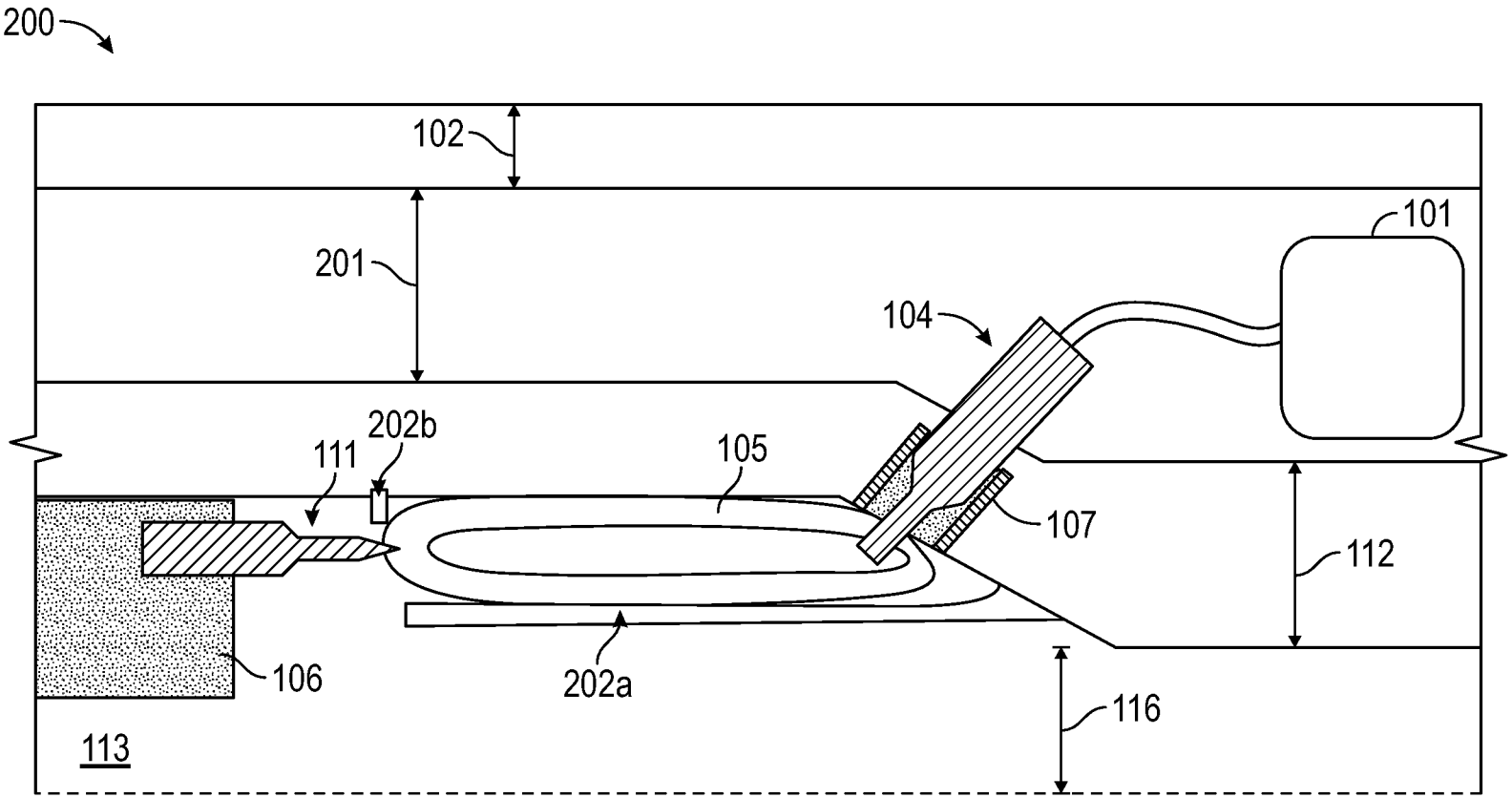
FIG. 2 shows an example system of how a conformal multilayer soft shell apparatus may be installed in a wellbore according to embodiments herein.

In some embodiments, the conformal multilayer soft shell apparatus may be connected to a connector at the surface of the well and installed in the wellbore as part of a lower receptacle as shown in FIG. 2. FIG. 2 shows an example system 200 of how the conformal multilayer soft shell apparatus 105 may be installed in, for example, a lateral wellbore 201. A downhole system requiring power 101 is pre-installed in a section of lower completion tubing 112 prior to running the tubing in the lateral wellbore 201. The downhole system requiring power 101 contains a female connector 104 and a mating connector 107 which is attached to the conformal multilayer soft shell apparatus 105. The conformal multilayer soft shell apparatus 105 is supported onto the lower completion tubing 112 by an apparatus support 202*a*, 202*b*. In one or more embodiments, apparatus support 202 includes a threaded support ring or machined annular pocket and a snap ring or threaded retainer. When it is desired to provide power to the downhole system requiring power 101, upper completion tubing 106 is used to run-in-hole a male connector with stabbing tool 111. When the upper completion tubing 106 reaches the location of the conformal multilayer soft shell apparatus 105 in the wellbore 201, the male connector with stabbing tool 111 stabs into the conformal multilayer soft shell apparatus 105. This completes the electrical connection pathway between the downhole system requiring power 101, the male connector with stabbing tool 111 and the electrical power supply 110 (shown in FIG. 1).

In one or more embodiments, the male and/or female connections depicted in FIG. 2 may be provided by wireline. In one or more embodiments, the male and/or female connections may be made by two casing joints.

The stabbing tool may house a power cable, and therefore, it is beneficial to protect the stabbing tool of a connection mechanism from environmental fluids in the wellbore. In one or more embodiments, the connection mechanism is protected by a mechanical or a chemical protective barrier. A mechanical protective barrier may be any known in the art, such as a retractable sleeve. In this case, the retractable sleeve would be positioned to move with the stabbing tool, such that the power cable would be protected from environmental fluids during stabbing action. In one or more embodiments, the connection mechanism is protected by a chemical protective barrier. A chemical protective barrier may be any known in the art, such as a self-passivating material like niobium. In this case, niobium, or a similar chemical, would create a thin protection layer on the stabbing tool when the stabbing tool is exposed to a water based environmental fluid. One or more of the layers of the conformal multilayer soft shell apparatus may then, for example, act to scrape the niobium coated connector during the stabbing step to remove the passivation layer and expose the conductive metal to form an electrical connection.

Figure 3A:
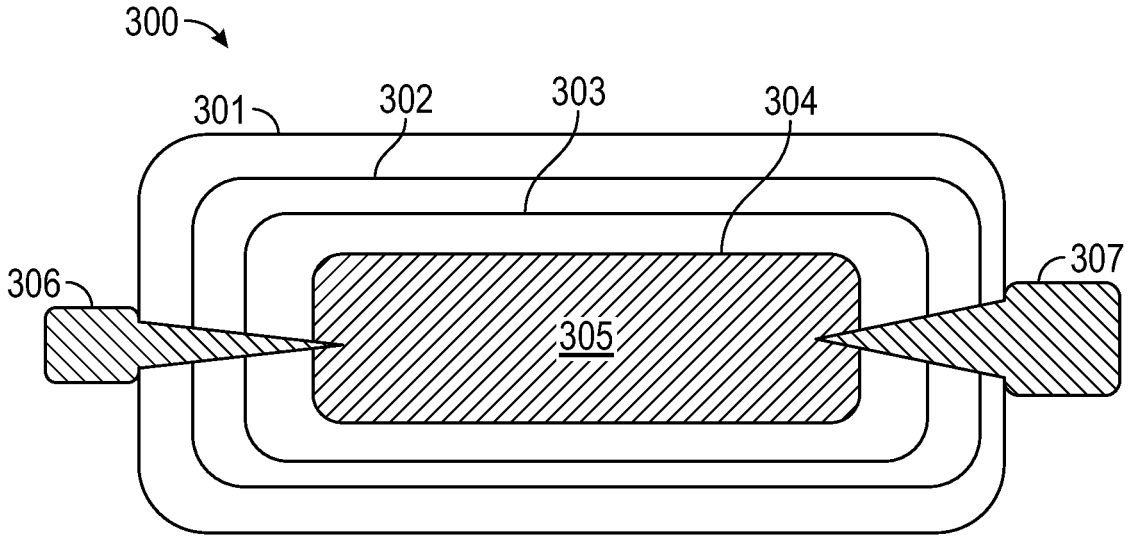
FIGS. 3A-3E show different iterations of a conformal multilayer soft shell apparatus according to embodiments herein.

FIG. 3A shows a radial cross-section of one iteration of the conformal multilayer soft shell apparatus described in one or more embodiments. In this configuration, the multi-layer soft shell apparatus 300 contains a plurality of layers. The outermost layer 301 surrounds N number of middle layers. The Ni middle layer 302 contacts the outermost layer. Then, the $N_2$ middle layer 303 contacts the Ni middle layer, and so on, until the desired N number of middle layers is achieved. The innermost layer 304 contains an electrically conductive material 305.

In one or more embodiments, the electrically conductive material is one or more materials selected from any of the categories of metals, metal alloys, or native or engineered non-metallics or composites. The electrically conductive material may be magnetic or non-magnetic. The form of the electrically conductive material may be solid, liquid, granular, or any combination thereof. The electrically conductive material may also be in the form of a soft pliable matrix or gel. The electrically conductive material may also be a non-metallic powder or gel matrix that has conductive properties. In some embodiments, the electrically conductive material is in the form of a granule, and the granules may be macro or nano powders formed from metallic or conductive non-metallic materials.

Keeping with FIG. 3A, a connection mechanism shown, for example, includes a female connector 306 which is pre-installed at one axial end of the conformal multilayer soft shell apparatus 300, and the male connector 307 is located on the opposite axial end of the conformal multilayer soft shell apparatus. When the female connector 306 and the male connector 307 are both in contact with the electrically conductive material 305 contained in the innermost layer 304 of the apparatus, a conductive electrical pathway is created.

Figure 3B:
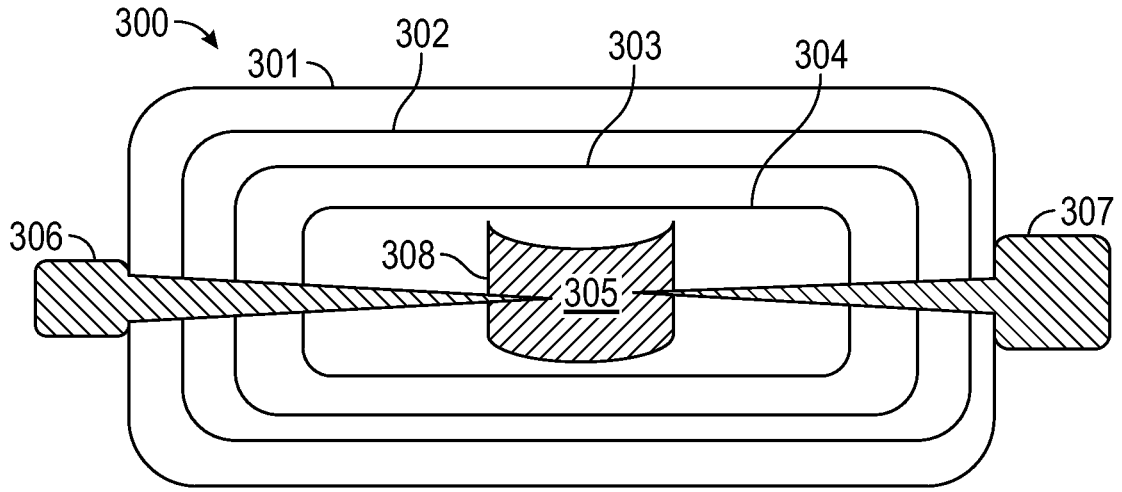

FIG. 3B shows another iteration of a radial cross-section of the conformal multilayer soft shell apparatus 300. In this configuration, the conformal multilayer soft shell apparatus 300 may contain a plurality of layers as described in FIG. 3A. In FIG. 3B, however, the electrically conductive material 305 is in the form of granules which are contained in a receptacle 308, such as a pocket, bowl, cavity, or recess, within the innermost layer 304. The receptacle 308 retains the granular electrically conductive material 305 vertically by gravity so it cannot fall out when the conformal multilayer soft shell apparatus 300 is deployed into the wellbore.

Figure 3C:
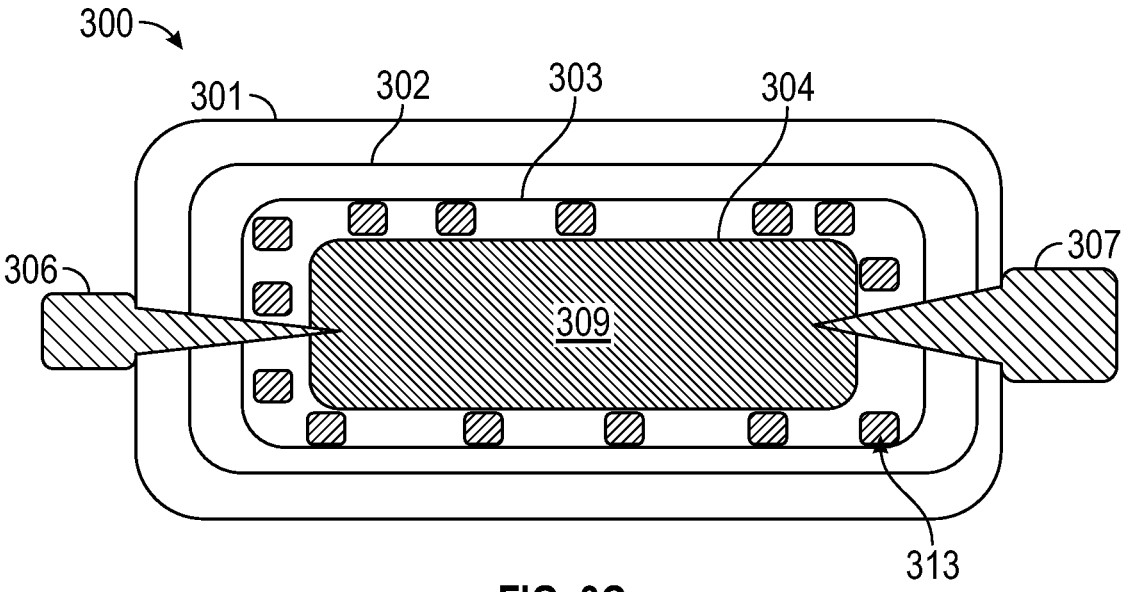

FIG. 3C shows yet another iteration of a radial cross-section of the conformal multilayer soft shell apparatus 300. In this configuration, the conformal multilayer soft shell apparatus 300 may also contain a plurality of layers as described in FIG. 3A. In FIG. 3C, however, the electrically conductive material is magnetic or contains magnetic particles, such as ferrite particles or a ferrofluid 309. The magnetic electrically conductive material 309 is in the form of granules or liquid and is contained in the innermost layer 304, as described in FIG. 3A. Magnets 313 are embedded in one or more layers of the conformal multilayer soft shell apparatus 300. While the conformal multilayer soft shell apparatus 300 is deployed into the wellbore, magnets contained in one or more layers 313 may be used to retain the magnetic electrically conductive material 309 within the innermost layer 304 of the conformal multilayer soft shell apparatus 300.

Figure 3D:
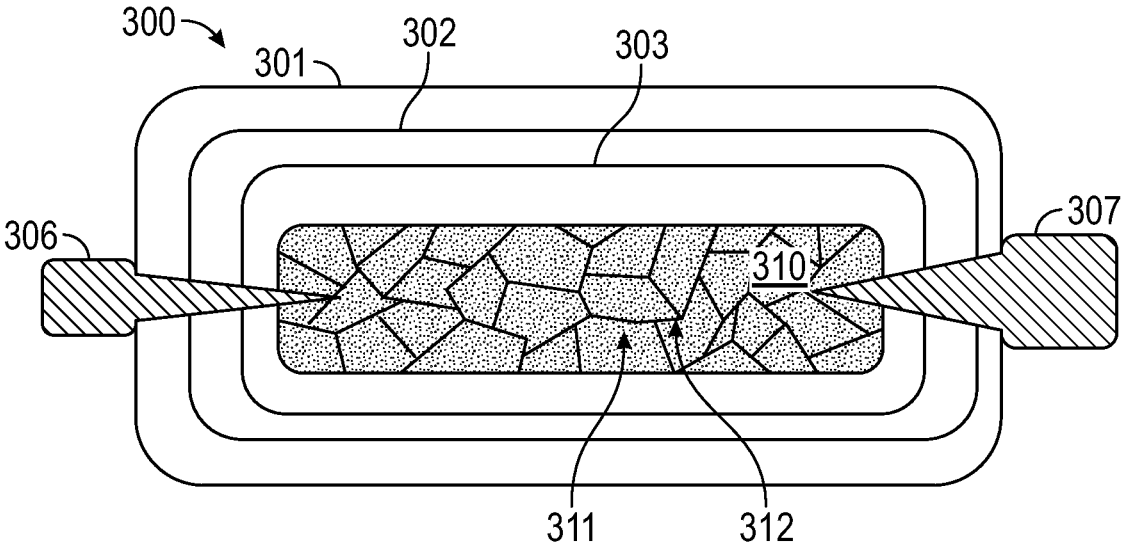

FIG. 3D shows another iteration of a radial cross-section of the conformal multilayer soft shell apparatus described in one or more embodiments. Similar to the embodiment presented in FIG. 3A, the multilayer soft shell apparatus 300 of FIG. 3D contains a plurality of layers. In FIG. 3D, the innermost layer 310 contains a porous matrix 311 in which multiple connected channels 312 are pre-infused with the electrically conductive material.

Figure 3E:
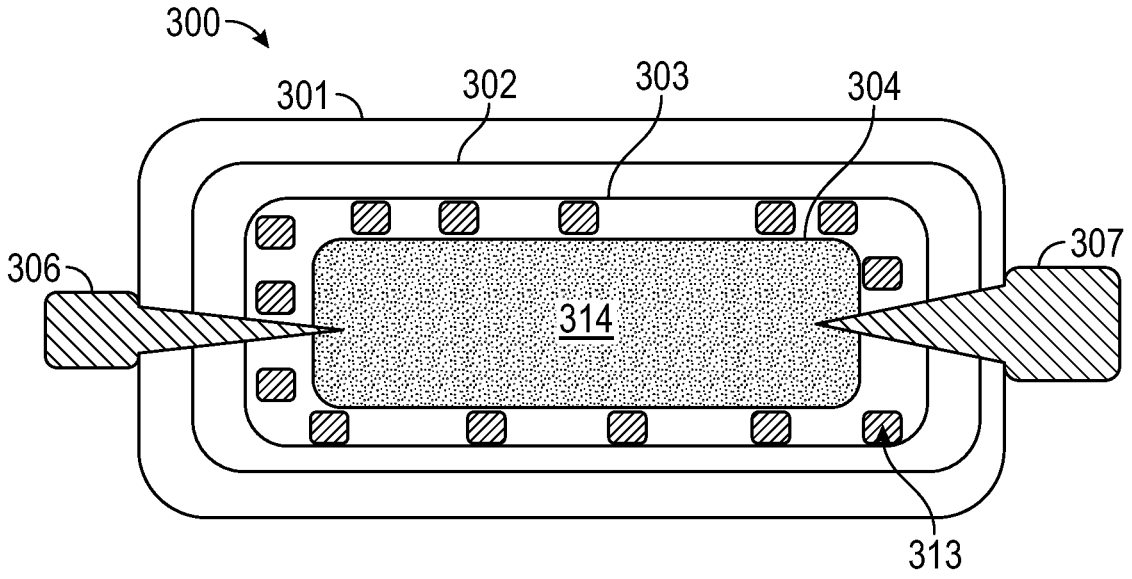

FIG. 3E shows yet another iteration of a radial cross-section of the conformal multilayer soft shell apparatus 300. In this configuration, the conformal multilayer soft shell apparatus 300 may also contain a plurality of layers as described in FIG. 3A. In FIG. 3E, however, the electrically conductive material is a metallic or ceramic-metal composite based gel, such as a nanoparticle-laden hydrogel or a mxenes hydrogel 314. The electrically conductive material 314 is in the form of a gel contained in the innermost layer 304, as described in FIG. 3A. Magnets 313 are embedded in one or more layers of the conformal multilayer soft shell apparatus 300. While the conformal multilayer soft shell apparatus 300 is deployed into the wellbore, magnets contained in one or more layers 313 may be used to retain the electrically conductive material 314 within the innermost layer 304 of the conformal multilayer soft shell apparatus 300.

In one or more embodiments, FIG. 3C and FIG. 3E may be modified to remove the magnets 313. In this case, the electrically conductive material 309 in FIG. 3C or 314 in FIG. 3E may be retained based on volume fill in cavity and flexibility of the layers providing pressure compensation.

The innermost layer 310 of FIG. 3D may be a porous matrix containing connected channels. The conductive material is pre-infused into the channels and provide multiple connection points with the channels that are in contact with the stabbed electrical connector, while still allowing for isolation from environmental fluids. As compared to the iteration depicted in FIG. 3A, the porous matrix contained in the innermost layer of FIG. 3D provides better structural properties of the apparatus while still providing the ease of penetration through soft materials.

Each layer of the conformal multilayer soft shell apparatus may be constructed of a self-healing material. The layers may also be constructed of a dissolvable or degradable material. The one or more layers in the multilayer soft shell apparatus may be made of the same or of different materials.

The layer or layers of the conformal multilayer soft shell apparatus may have different properties which may be tailored for specific functions within the apparatus. For example, the main purpose of the conformal multilayer soft shell apparatus is to isolate an electrically conductive material from environmental fluids in a wellbore. Layers may be configured to provide fluids isolation, dielectric interface, and pressure compensation, among other functions. One or more layers may also serve to clean the connectors of residual fluid during the stabbing action, and the layers may have a designed combination of hydrophobic and hygroscopic surfaces and volumes to allow for effective cleaning of the conductor before electrical connection is made. For example, a modifying agent might be included in one or more layers to remove tarnish or corrosion from entering the connector lead to help improve electrical contact. The modifying agent may be an acid or similar chemical which removes surface oxide to improve electrical conductivity.

In one iteration, the outermost layer may be a polymeric sheathing with a defined overlapping or labyrinth cut. The outermost layer may act like an external cover to the conformal multilayer soft shell apparatus. This layer may seal at low pressures and restrict fluid ingress by filtering and minimizing flow area.

In some embodiments, the apparatus is constructed of non-metallic materials which minimizes the use of structural support metal alloys. Tubulars or pressure retaining bodies or encasements may typically be made of metal. In one or more embodiments, the apparatus is constructed of non-metallic material, such as a high performance polymer composite. Because high performance polymer composites are more resistant to corrosion by hydrogen sulfide ($H_2S$) gas, the apparatus is suitable for use in such environments while still providing reliable electrical connections.

To maintain fluid isolation after piercing or stabbing of the layer occurs, one or more layers of the conformal multilayer soft shell apparatus may be made of a self-healing material. In which case, the self-healing layer or layers heal through recovery upon un-stabbing and disconnecting the male and female connection. Therefore, there is minimal to no seepage or contamination of the internal sac liquid metal or granules and environmental fluids due to a balanced or positive pressure within the sac, compliant material properties and a self-healing ability of the layered shell or sac. Positive pressure may be created through the difference in thermal expansion of liquid conductive materials and the environmental fluids. In general, liquid metals or metal alloys are incompressible fluids. Because the conformal multilayer soft shell apparatus is deformable, the environmental fluid pressure may equalize with that of the liquid conductive material, while the apparatus retains its shape.

Examples of self-healing materials may include a self-healing polymer sac or hydrogel, a shape memory gel, shape memory alloys, self-healing elastomers, high viscosity hydrogels, mxenes-based hydrogels, shape memory non-metallic materials, nastic materials, epoxy resins with microcapsules containing self-healing agents, or any combination or hybrid formula thereof. The self-healing material or materials may be autonomic or non-autonomic, or intrinsic or extrinsic self-healing materials.

One or more layers of the conformal multilayer soft shell apparatus may also be made of dissolvable or degradable materials. In this case, once the electrical connection is formed, a mechanism could be deployed to dissolve or degrade the one or more layers made of dissolvable or degradable material. This could be accomplished via chemical action, the pumping of a specified activator fluid, or via the establishment of a potential difference across the layers that would artificially corrode the structure and release the inner electrically conductive material.

In one or more embodiments, the outermost layer is insoluble in both water and oil such that it will not dissolve when placed in downhole environments containing aqueous or oleaginous environmental fluids.

In one or more embodiments where the electrically conductive material is in the form of a soft pliable matrix or gel, the conformal multilayer soft shell apparatus may contain only one layer.

In some embodiments, the electrically conductive material is in the form of granules contained in a pocket, bowl, cavity or recess such that the metal is retained vertically by gravity and cannot fall out when the conformal multilayer soft shell apparatus is deployed.

In some embodiments, the electrically conductive material is in the form of granules or liquid and is retained by magnets such that it cannot fall out when the conformal multilayer soft shell apparatus is deployed. In this case, the electrically conductive material may itself be magnetic or may contain magnetic particles such as ferrite particles or a ferrofluid.

In some embodiments, the electrically conductive material is in the form of granules or liquid and is retained by magnets such that it cannot fall out when the conformal multilayer soft shell apparatus is deployed. In this case, the electrically conductive material may be a metallic gel or a ceramic-metallic composite based gel.

Some examples of electrically conductive materials are liquid metals, such as those made of Ga, In, Sn and their alloys, such as Galinstan or EGaIn, granular metals or metallic alloys, granular non-metallic conductive materials, nanoparticle modified organic formulations, conductive plastic based composites, polymeric formulations with conductive additives, different forms of carbon black or carbon nanotubes, and different forms of graphene or graphene based materials.

In one or more embodiments, the electrically conductive material may be a eutectic alloy whose electrical and thermal properties and density depend on temperature.

In one or more embodiments, the physical state of the electrically conductive material may change in high pressure environments, such as that of a wellbore. For example, the electrically conductive material may be in the form of a liquid at low pressure and may be in the form of a solid at higher pressure.

In one or more embodiments, the melting point of the electrically conductive material is less than 25° C. The melting point of the electrically conductive material of one or more embodiments has a melting point in a range having a lower limit of any one of −200, −100, −50, −10, 0, 5, 10, and 15° C. and having an upper limit of any one of 20, 22, and 25° C. where any lower limit may be paired with any mathematically compatible upper limit.

In one or more embodiments, the boiling point of the electrically conductive material is greater than 1000° C. The boiling point of the electrically conductive material of one or more embodiments has a boiling point in a range having a lower limit of any one of 1000, 1100, and 1200° C. and having an upper limit of any one of 1300, 1500, 2000 and 5000° C. where any lower limit may be paired with any mathematically compatible upper limit.

Figures 4A, 4B, 4C, 4D, 4E, 4F, 4G:
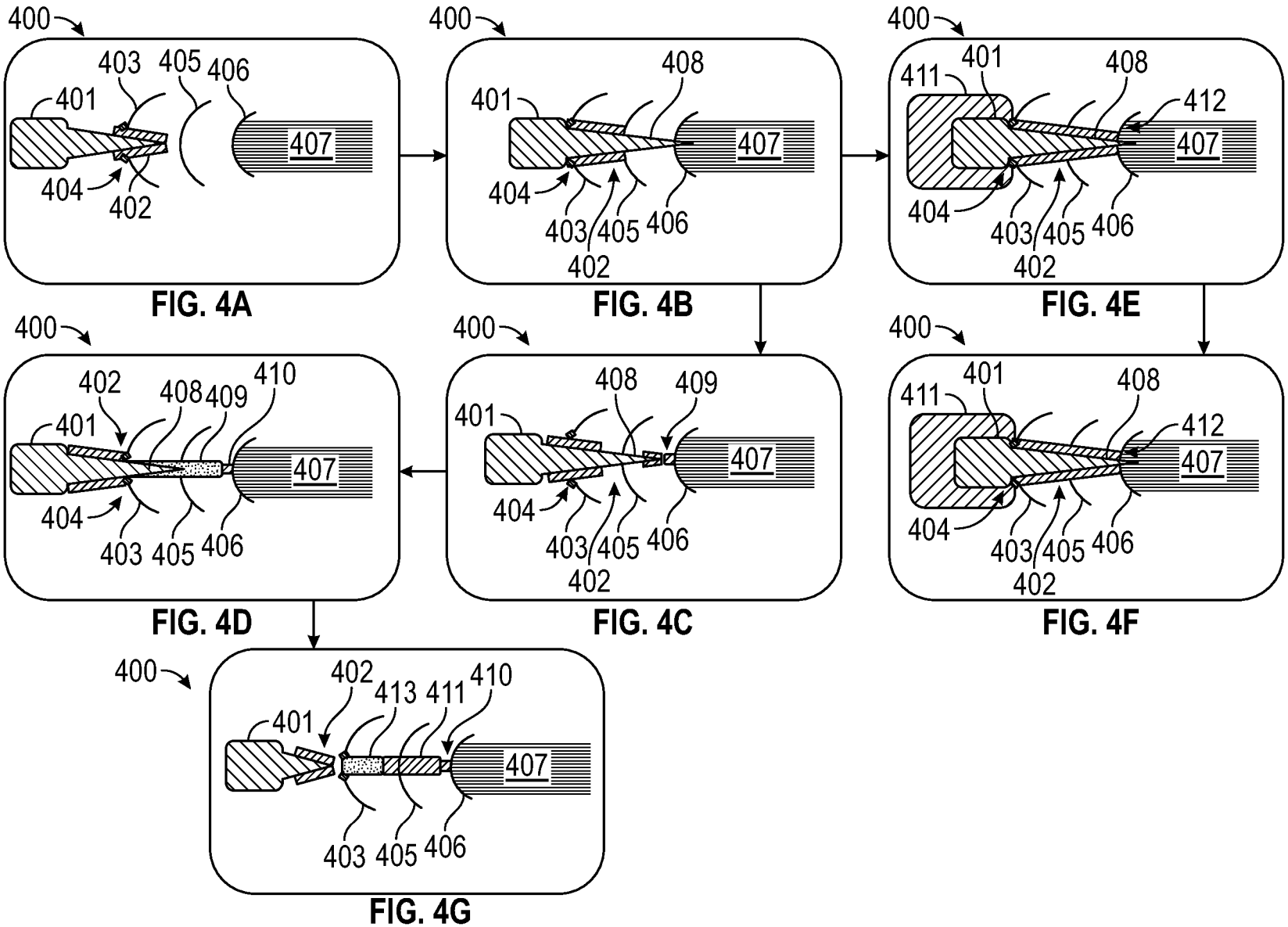
FIGS. 4A-4G show an example of how the conformal multilayer soft shell apparatus of one or more embodiments may be contacted according to embodiments herein.

FIG. 4 shows a radial cross-section of an example self-healing conformal multilayer soft shell apparatus. FIG. 4A illustrates an example of how the self-healing conformal multilayer soft shell apparatus 400 of one or more embodiments may be contacted. The stabbing tool 401, shown with an optional retractable, protective sleeve 402, first stabs through the outermost layer 403 of the self-healing conformal multilayer soft shell apparatus 400. In the process, some of the material from the outermost layer is damaged, represented by small dotted squares 404. In this first step, the middle N layer or layers 405 are not yet contacted, nor is the innermost layer 406 containing the electrically conductive material 407.

In FIG. 4B, the stabbing tool 401 now stabs through the middle N layer or layers 405 and the innermost layer 406 to reach the electrically conductive material 407. The connector lead 408 is now exposed from the protective sleeve 402 and may have been wiped clean, for example, by piercing through the middle N layer or layers 405, which may be configured with a cleaning solution, such as an acid. The connector lead 408 now makes contact with the electrically conductive material 407 and an electrical pathway is established between the connector lead 408 and a second connector (not pictured). The electrical pathway provides power from the electric power supply 110 at the wellhead through the connector lead 408, the electrically conductive material 407, and the second connector. When the operation is complete and it is desired to remove the connector lead 408 and unmake the electrical connection, the stabbing tool then begins to recede from the innermost layer 406, as described in FIG. 4C.

FIG. 4C shows how the stabbing tool 401 begins to recede from the self-healing conformal multilayer soft shell apparatus 400. The connector lead 408 first un-stabs from the innermost layer 406 of the self-healing conformal multilayer soft shell apparatus 400. As the connector lead recedes, material damage from the innermost layer occurs, shown as dotted grey squares 409. The protective sleeve 402 begins to recede as the connector lead moves through the inner N layer or layers 405.

FIG. 4D shows further recession of the stabbing tool 401 as it continues to move out of the self-healing conformal multilayer soft shell apparatus 400. The connector lead 408 now un-stabs from the inner N layer or layers 405. Further material damage 409 is caused as the connector lead recedes. The protective sleeve 402 further recedes to protect the connector lead. Subsequently, the material that was previously damaged at the contact point of the connector lead and the innermost layer begins to self-heal 410. Eventually, the connector lead reaches the outermost layer, and the protective sleeve 402 moves back into place. The protective sleeve 402 again covers the connector lead 408 as it un-stabs from the outermost layer 403 and again contacts the wellbore fluids, as described in FIG. 4A.

FIG. 4E shows a variation in the example of how the self-healing conformal multilayer soft shell apparatus 400 of one or more embodiments may be contacted, as previously described in FIGS. 4A-D. As shown in FIG. 4E, stabbing tool 401 contains a protective sleeve 402, as described in FIG. 4A. Now, the protective sleeve 402 is connected to a protective outer receptacle 411 which surrounds the stabbing tool 401. The stabbing tool 401 stabs the plurality of layers until it reaches the innermost layer 406, as previously described. However, when the stabbing tool 401 of FIG. 4E reaches the innermost layer 406, it causes the innermost layer 406 to rupture, where the ruptured portion of the innermost layer 406 is shown as 412 in FIG. 4E.

In FIG. 4F, the innermost layer 406 is ruptured as described with respect to FIG. 4E. Now, the electrically conductive material 407 begins to flow into the protective sleeve 402 and subsequently into the protective outer receptacle 411. When the electrically conductive material 407 fills the protective sleeve 402 and the protective outer receptacle 411, an electrical connection is established between the connector lead 408 and a second connector (not pictured) of the connection mechanism. Meanwhile, as shown in FIG. 4G, the innermost layer 411 and the middle layer 410 are fully healed and the outermost layer continues to heal 413.

In one or more embodiments, the innermost layer 406 contains a porous matrix, such as the one described in FIG. 3D, as the electrically conductive material 407.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures.

What is claimed:

1. A conformal multilayer soft shell apparatus, comprising:

one or more layers, further comprising;

at least an innermost layer, wherein the innermost layer contains one or more electrically conductive materials;

N middle layers, wherein N is an integer from 0 to 10; and an outermost layer, wherein the one or more layers comprises one or more of the following: a self-healing material, a degradable material, or a dissolvable material.

2. The conformal multilayer soft shell apparatus of claim 1, wherein the one or more electrically conductive materials is selected from the following: metals, metal alloys, or native or engineered non-metallics or composites.

3. The conformal multilayer soft shell apparatus of claim 1, wherein the one or more electrically conductive materials is in the form of a liquid.

4. The conformal multilayer soft shell apparatus of claim 1, wherein the one or more electrically conductive materials is in the form of a solid.

5. The conformal multilayer soft shell apparatus of claim 1, wherein the innermost layer further comprises the one or more electrically conductive materials enclosed in a soft pliable matrix or a gel.

6. The conformal multilayer soft shell apparatus of claim 1, wherein the innermost layer further comprises;

a porous matrix; and a plurality of connected channels, wherein the one or more electrically conductive materials is pre-infused into the plurality of connected channels.

7. The conformal multilayer soft shell apparatus of claim 1, wherein the innermost layer further comprises a pocket, bowl, cavity, or recess configured to contain the one or more electrically conductive materials vertically by gravity.

8. The conformal multilayer soft shell apparatus of claim 1, wherein the one or more electrically conductive materials is magnetic.

9. The conformal multilayer soft shell apparatus of claim 1, wherein the one or more electrically conductive materials is non-magnetic.

10. The conformal multilayer soft shell apparatus of claim 1, wherein the outermost layer is insoluble in both water and oil.

11. The conformal multilayer soft shell apparatus of claim 1, wherein an acid is encapsulated between two of the N middle layers.

12. A system to create a downhole electrical connection, comprising:

an electric power supply;

the conformal multilayer soft shell apparatus of claim 1;

a downhole system requiring power; and a connection mechanism comprising at least two connectors, including at least a first connector and a second connector, wherein the first connector is configured to make electrical contact with the electric power supply and the conformal multilayer soft shell apparatus, and wherein the second connector is configured to make electrical contact with the conformal multilayer soft shell apparatus and the downhole system requiring power.

13. The system of claim 12, wherein the first connector or the second connector is pre-installed in the conformal multilayer soft shell apparatus.

14. The system of claim 12, wherein the connection mechanism is protected by a mechanical barrier or a chemical barrier.

15. The system of claim 14, wherein the mechanical barrier is a retractable sleeve.

16. The system of claim 14, wherein the chemical barrier is a self-passivating lead material.

17. The system of claim 12, further comprising:

upper completion tubing; and lower completion tubing, wherein the first connector is disposed on the upper completion tubing and the second connector is disposed on the lower completion tubing.

18. A method to create a downhole electrical connection, comprising:

stabbing, with a stabbing tool, the outermost layer of the conformal multilayer soft shell apparatus of claim 1; and stabbing the N middle layers of the conformal multilayer soft shell apparatus until the stabbing tool contacts the one or more electrically conductive materials of the innermost layer.

19. The method of claim 18, wherein the outermost layer of the conformal multilayer soft shell apparatus is dissolved or degraded once the downhole electrical connection is established.

* * * * *